US006347964B1

(12) United States Patent
Kuan

(10) Patent No.: US 6,347,964 B1
(45) Date of Patent: Feb. 19, 2002

(54) PLUG CONNECTOR

(75) Inventor: Chi-Te Kuan, Taipei Hsien (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/607,863

(22) Filed: Jun. 30, 2000

(51) Int. Cl.[7] ..... H01R 13/64
(52) U.S. Cl. ..... 439/680; 439/607
(58) Field of Search ..... 439/680, 681, 439/607–610

(56) References Cited

U.S. PATENT DOCUMENTS 4,422,706 A * 12/1983 Neuhouser ..... 439/680
4,611,878 A * 9/1986 Hall et al. ..... 439/680
4,857,016 A * 8/1989 Benscoter et al. ..... 439/680
5,417,590 A * 5/1995 Dechelette et al. ..... 439/680
5,549,488 A * 8/1996 Berndt et al. ..... 439/680

* cited by examiner

*Primary Examiner*—Hien Vu
(74) *Attorney, Agent, or Firm*—Pro-Techtor International Services

(57) ABSTRACT

A plug connector, comprising: an insulating casing, a terminal unit accommodated in the insulating casing, a conductive terminal assembled to the terminal unit, and an obstruction unit, characterized in that: the terminal unit comprises a foundation and a square accommodating chamber that extends from the foundation, and on the accommodating chamber is a penetrating assembling hole; the obstruction unit enveloping the square accommodating chamber, and between the obstruction and the square accommodating chamber is a location identifying device, such structural characteristics composing a fully innovated structure of plug connector, and the location identifying device serving to ensure correct orientation of the plug connector and correct connection with the socket connector.

8 Claims, 4 Drawing Sheets

PLUG CONNECTOR

BACKGROUND OF THE INVENTION

1. Field of the Invention

The present invention relates to a plug connector, particularly a charging plug at is used for connection with a charger, with a small size of communication transmission end and protection against misconnection, to provide stable transmission of telecommunication signals.

2. Description of Related Art

Conventionally, a plug connector and a socket connector are coupled for telecommunication transmission to avoid short-circuit and provide operating space or the conductive terminal. To meet the requirement for injection forming, the size of a prior art of socket connector is large, and the size of its matching plug connector could not be reduced, so the prior art could not meet the trend for light weight and compactness. As shown in FIG. 1, a conventional socket connector 1 used for charging a mobile phone has a round inserting hole 10, which is restricted by the strength of plastic injection molding, the size of a conventional socket connector 1 could not be reduced, therefore, the size of contact end 20 in the shape of a hollow column in a matching plug connector 2 could not be reduced. In view of that drawback, the applicant has disclosed in patent No. 89203120 a structure enabling possible reduction of the height of a charging socket connector, in that patent the charging socket connector and a metal obstruction unit and a charging terminal unit combine to shape a frame of square charging insert slot, the frame of metal obstruction unit serving to replace plastic injection molding to effectively reduce its integral height, so that the integral thickness of the assembled mobile phone can be reduced.

SUMMARY OF THE INVENTION

It is therefore an objective of this invention to provide an innovative structure with size and configuration completely different from the conventional hollow column structure to effectively reduce the size of contact end and coordinate with a matching socket connector, to meet the trend of design for light weight and compactness.

It is another objective of this invention to provide an innovative structure with protection against misconnection, and ensure correct transmission of communication signals and connection.

CHARACTERISTICS OF THE INVENTION

The present invention of plug connector comprises: an insulating casing, a terminal unit accommodated in the insulating casing, a conductive terminal assembled on the terminal unit, and an obstruction unit, characterized in that: the terminal unit comprises a foundation and a square accommodating chamber extending from the foundation, and on the accommodating chamber is a penetrating assembling hole; the obstruction unit encompassing the square accommodating chamber, thus to compose a fully innovated structure.

Another characteristic of the invention of plug connector lies in that, between the obstruction unit and the square accommodating chamber is a location identifying device, which ensures correct orientation of the plug connector and correct connection with the socket connector.

With the above characteristics, the location identifying device has a depressed groove on the square accommodating chamber, and the obstruction unit has a matching depressed groove at an opposite position.

BRIEF DESCRIPTION OF DRAWINGS

The invention can be fully understood by reading the following detailed description of the preferred embodiments, with reference made to the accompanying drawings, wherein.

DETAILED DESCRIPTION OF PREFERRED EMBODIMENTS

Figure 2:
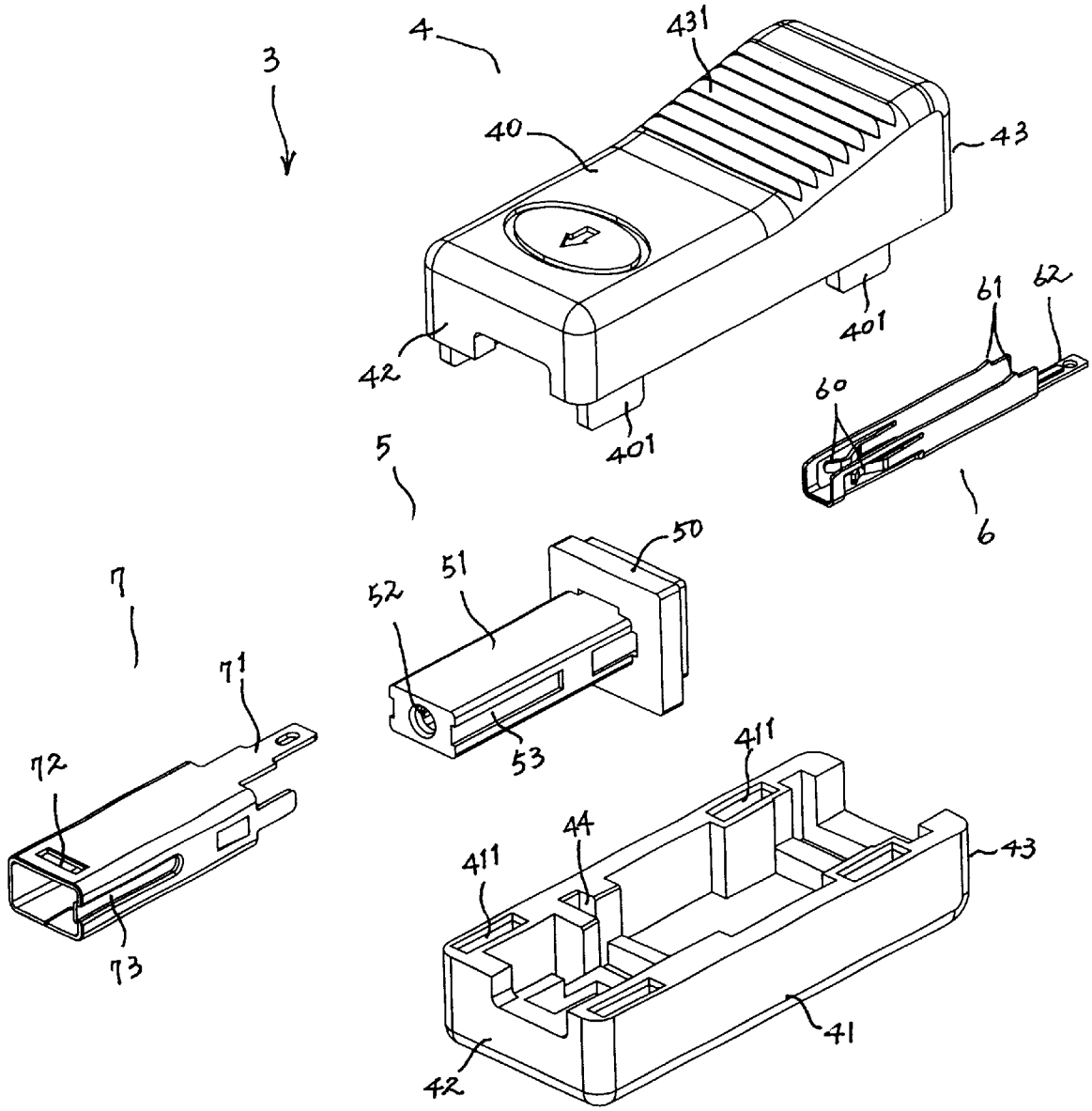
FIG. 2 is a perspective, disassembled view of the invention of plug connector.

As shown in FIG. 2, the invention of plug connector 3 comprises: an insulating casing 4, a terminal unit 5, a conductive terminal 6, and an obstruction unit 7, wherein, said insulating casing 4 has a first casing 40 and a second casing 41, wherein, on the first casing 40 is a snap post 401, and on the second casing 41 opposite the snap post 401 is a snap groove 411, whereby the two can be fastened as one unit. The first casing 40 and the second casing 41 respectively have corresponding coupling side 42 and connecting side 43, and inside the first and second casings 40, 41 are embedding grooves 44, which serve to assemble and fix the terminal unit 5. On the connecting side 43 of the first casing 40 is a protrusion 431 with a rough surface to facilitate gripping.

The terminal unit 5 is assembled between the first and the second casings 40, 41, comprising a foundation 50 and a square accommodating chamber 51 that extends from the foundation 50, wherein, the foundation 50 is located at the connecting side 43 of the insulating casing, and the square accommodating chamber 51 is located at the connecting side 42 of the insulating casing, and on the accommodating chamber 51 is an assembling hole 52 that penetrates to the foundation 50, serving to accommodate the conductive terminal 6. When the components are assembled, the foundation 50 of the terminal unit 5 is embedded in the embedding groove 44 of the aforementioned first and second casings 40, 41.

Figure 5:
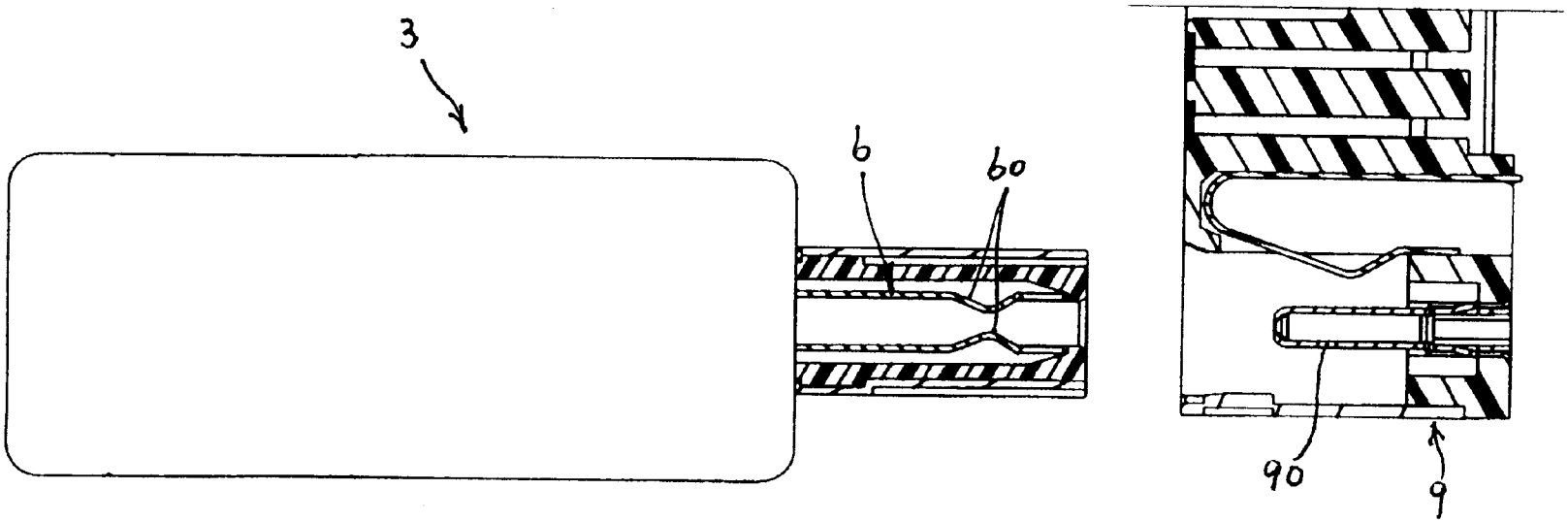
FIG. 5 is a regional section view of the invention of plug connector and socket connector before they are coupled.

The conductive terminal 6 is a positive pole for connection, in a U-shape, assembled in the accommodating chamber 5 of the terminal unit 5, having a contact part 60, an interference part 61 and a connecting part 62, wherein the contact part 60 having a clamping strength is punch pressed on the sides of two sides of the U-shape, while the interference part 61 having reversed hooks is on the other sides of two sides of the U-shape, the connecting part 62 is an extension from the U-shape opposite the bottom of the contact part for connection with the power cable. As shown in FIG. 5, the contact part of the conductive terminal 6 is located near the assembling hole 52 of the terminal unit 5, and can be clasped with the terminal 90 of a coupling socket connector 9.

The obstruction unit 7, covering the square accommodating chamber 51, has hollow two sides opposite the assembling hole 52 of the terminal unit 5, and on one side opposite the foundation 50 of the terminal unit 5 is an extension of a second terminal 71, which serves as the connecting end for a negative pole. On the obstruction unit 7 is a snap opening 72 that can be fastened with a coupling charging socket. Between the obstruction unit 7 and the square accommodating chamber 51 is a location identifying device, which ensures correct orientation of the socket connector and correct coupling of the socket connector. The location identifying device has a depressed groove 53 on the square accommodating chamber 51, and at the opposite location on the obstruction unit 7 is a matching depressed groove 73.

Figure 1:
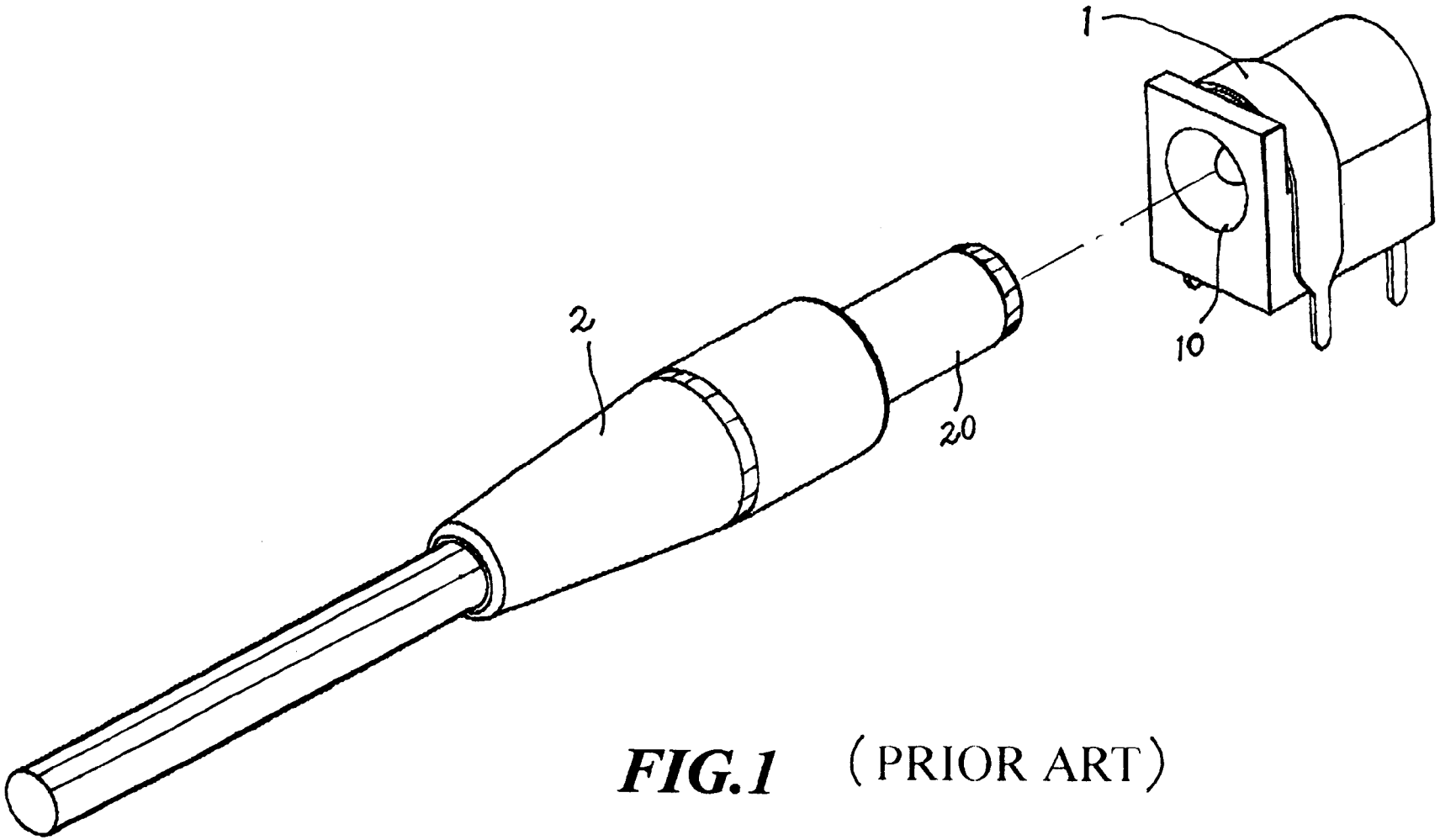
FIG.1 (PRIOR ART)
FIG. 1 is a perspective, disassembled view of a prior art of plug connector and socket.
Figure 3:
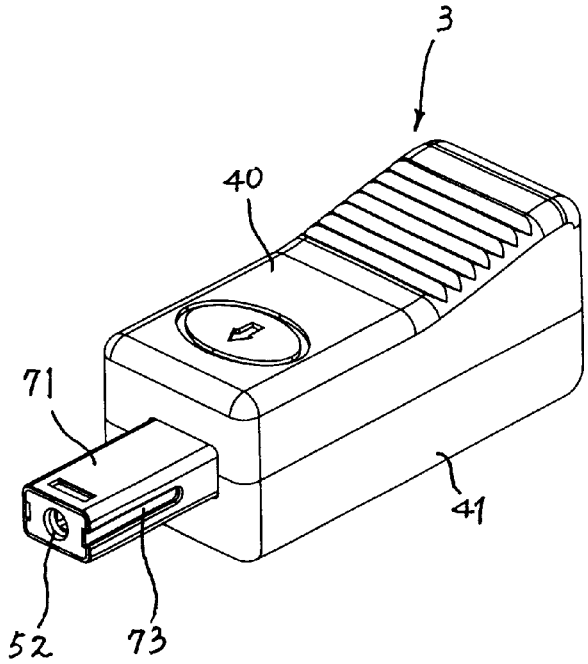
FIG. 3 is a perspective, assembled view of FIG. 2.
Figure 4:
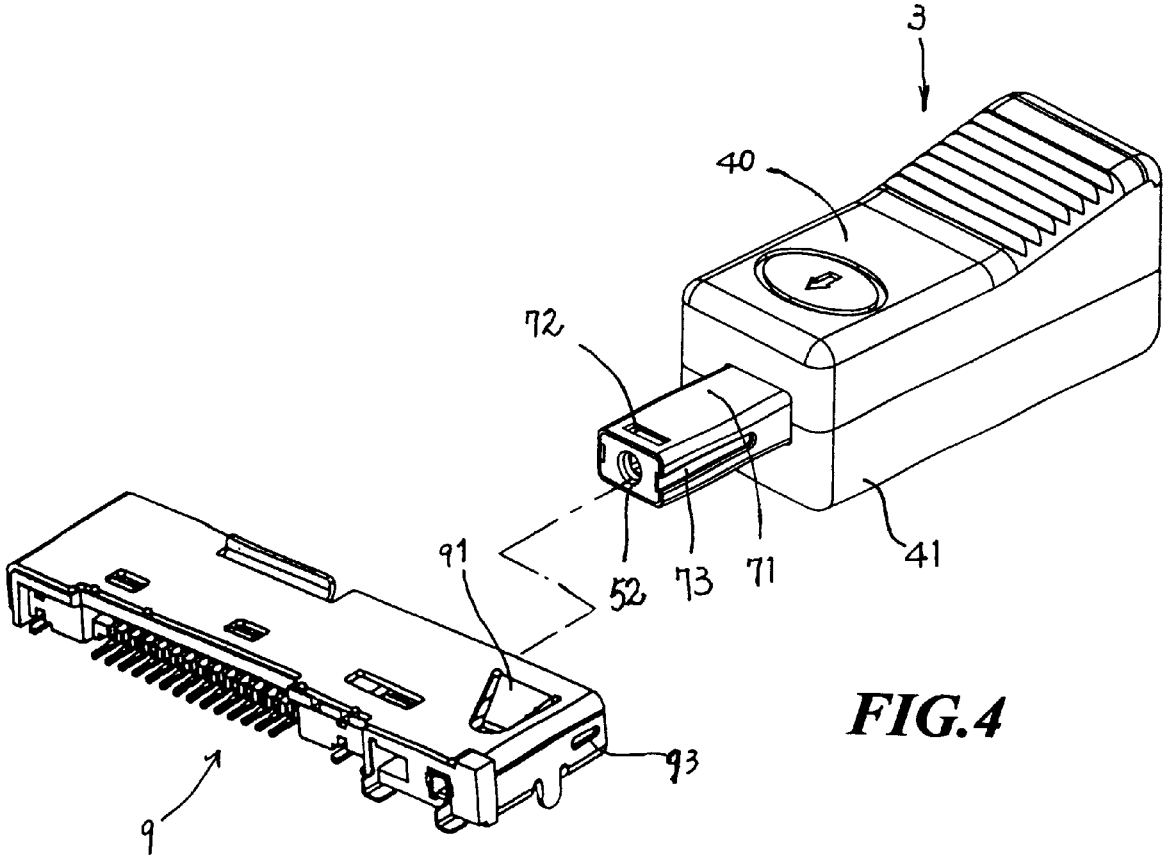
FIG. 4 is a perspective, disassembled view of the invention of plug connector and socket connector.
Figure 6:
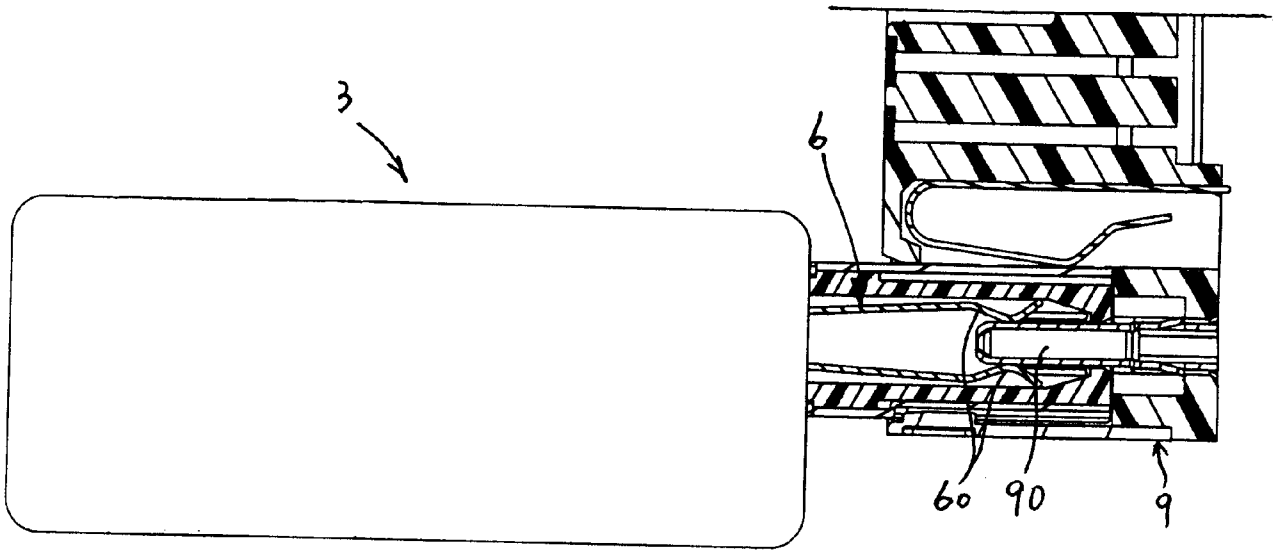
FIG. 6 is a regional section view of the invention of plug connector and socket connector after they are coupled.

As shown in FIG. 3 and FIG. 1, the invention is assembled by assembling the conductive terminal 6 on the square accommodating chamber 51 of the terminal unit 5, then the obstruction unit 7 is fixed to the accommodating chamber 51 of the terminal unit 5, then the foundation 50 of the terminal unit 5 is embedded in the embedding groove 44 of the first and second casings 40, 41, and finally the first and second casings 40, 41 are fastened together to become the assembled view shown in FIG. 3. Referring to FIG. 4, which is a disassembled view of the invention of socket connector 3 and a matching socket connector 9, the depressed groove 73 of the plug connector 3 must be correctly aligned for successfull coupling with the location identifying unit 93 on the socket connector 9. Any change of angle will result in failure of connection, therefore, it will prevent misconnection. As shown in FIGS. 5 and 6, the contact part 60 of the conductive terminal 6 of the plug connector 3 is firmly coupled with the terminal 90 of the socket connector 9, and, after they are coupled, the snap opening 72 of the obstruction unit 7 will be engaged with the tongue plate 91 on the socket connector 9, so as to ensure firm connection and stable transmission of telecommunication signals.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. A plug connector in combination with a receiving socket connector comprising:

an insulating casing, said insulating casing comprises a first casing section and a second casing section;

an insulative terminal unit assembled between said first casing and said second casing, said terminal unit comprising a foundation and an accommodating chamber extending from said foundation, said accommodating chamber being generally rectangular in cross section, wherein said foundation is located at a connecting side of said insulating casing and has a sectional area at least twice that of said accommodating chamber, and said accommodating chamber is located at a coupling side of said insulating casing, said accommodating chamber comprises a longitudinal assembling hole that extends from a distal end of said accommodating chamber to said foundation;

a first conductive terminal received in said accommodating chamber of said terminal unit; and a conductive obstruction unit that receives said accommodating chamber, said obstruction unit comprising a second conductive terminal at one end, wherein said first casing and said second casing each have an embedding groove at a position opposite said foundation of said terminal unit, said embedding grooves receiving a rim of said foundation of said terminal unit when said first casing and said second casing are joined together to form said insulating casing.

2. The plug connector in combination with a receiving socket connector as claimed in claim 1, wherein:

a location identifying means is situated between said obstruction unit and said accommodating chamber, said location identifying means ensuring correct orientation of said plug connector and said socket connector.

3. The plug connector in combination with a receiving socket connector as claimed in claim 2, wherein:

said location identifying means comprises a depressed groove on said accommodating chamber, and a corresponding depressed groove on said obstruction unit.

4. The plug connector in combination with a receiving socket connector as claimed in claim 1, wherein:

said insulating casing has a protrusion at said connecting side to facilitate gripping.

5. The plug connector in combination with a receiving socket connector as claimed in claim 4, wherein:

a surface of said protrusion on said insulating casing is rough so as to enhance friction when said protrusion is gripped.

6. The plug connector in combination with a receiving socket connector as claimed in claim 5, wherein:

said first casing comprises a post, and said second casing comprises a snap groove in a position corresponding to that of said post on said first casing, said post being received in said snap groove when said first casing and said second casing are joined together to form said insulating casing.

7. The plug connector in combination with a receiving socket connector as claimed in claim 1, wherein:

said obstruction unit has a fastener that is received in said socket connector.

8. The plug connector in combination with a receiving socket connector as claimed in claim 7, wherein:

said first conductive terminal has a U-shaped cross section, a first side of said first conductive terminal comprises a contact part, and on a top edge of a second side of said first conductive terminal is a reverse hook, and extending from a bottom of said first conductive terminal at an end opposite said contact part is a connecting part.

* * * * *